United States Patent [19]

Berlik

[11] Patent Number: 4,457,293

[45] Date of Patent: Jul. 3, 1984

[54] VENTILATED GAS RANGE WITH MODULAR COOKING UNITS

[75] Inventor: Lee J. Berlik, Cleveland, Tenn.

[73] Assignee: Raytheon Company, Lexington, Mass.

[21] Appl. No.: 484,081

[22] Filed: Apr. 11, 1983

Related U.S. Application Data

[62] Division of Ser. No. 260,655, May 4, 1981, Pat. No. 4,413,610.

[51] Int. Cl.[3] ..... F24C 3/00

[52] U.S. Cl. ..... 126/39 N; 126/39 M; 126/300; 126/214 R

[58] Field of Search ..... 126/39 R, 39 N, 39 M, 126/39 E, 214 R, 39 BA, 39 B, 211, 214 A, 214 B, 214 C, 9 R; 312/223, 236; 219/443, 444, 458

[56] References Cited

U.S. PATENT DOCUMENTS

| | | | |
|---|---|---|---|
| 1,342,436 | 1/1920 | Fry | 126/39 E |
| 1,445,984 | 2/1920 | Wilkinson | 126/39 E |
| 2,578,227 | 12/1951 | Chambers | 126/39 N |
| 3,015,329 | 1/1962 | Chambers | 126/39 N |
| 3,367,320 | 2/1968 | Jenn | 126/300 |
| 3,797,375 | 3/1974 | Cerola | 219/444 |
| 4,409,954 | 10/1983 | Berlik | 126/39 M |
| 4,413,610 | 11/1983 | Berlik | 126/39 K |

FOREIGN PATENT DOCUMENTS 1008770 11/1965 United Kingdom ..... 126/39 N

*Primary Examiner*—Samuel Scott
*Assistant Examiner*—G. Anderson
*Attorney, Agent, or Firm*—William R. Clark; Joseph D. Pannone

[57] ABSTRACT

A gas surface range having modular burner cartridges and a down draft ventilation system. The cartridges can be removed for repairing, cleaning, or changing the range top configuration. For example, one cartridge type may include tubular burners and an igniter mounted in a pan so that a grill may be positioned thereover to form a grilling surface. A second cartridge type may include conventional top surface burners and an igniter mounted in a pan. Each range compartment into which the cartridges insert have two orifice hoods and an electrical connector rigidly secured therein. The positioning of an inserted cartridge is such that the mixer heads of the burners align with the respective orifice hoods and a rigid conductor of the igniter makes electrical contact with the connector. The connector also has a second terminal for providing an electrical return for the igniter. One type of cartridge also includes an extending post which permits it to only be inserted in one particular compartment. Furthermore, its presence there is sensed so that activation of either burner automatically causes the down draft system to operate.

5 Claims, 14 Drawing Figures

VENTILATED GAS RANGE WITH MODULAR COOKING UNITS

CROSS-REFERENCE TO RELATED APPLICATIONS

This is a division of application Ser. No. 260,655, filed May 4, 1981, now U.S. Pat. No. 4,413,610.

BACKGROUND OF THE INVENTION

Electric surface ranges having modular plug-in cooking units are commercially available. Typically, these ranges have two compartments into which modular electric heating cartridges are inserted. One example of an electric cartridge configuration has two surface heating elements, one of which may be larger than the other. Another example configuration provides for grilling using an electric broil element. Furthermore, some of the commercially available modular electric ranges include a down draft ventilating system that draws air from the surface area through a duct for exhaust.

Heretofore, however, there have not been any modular cartridge gas ranges having a down draft ventilating system. As is well known, the technology and principles of operation of a gas range is much different than an electric range. Accordingly, the development of a cartridge gas range introduces many problems not encountered or appreciated with an electric unit.

SUMMARY OF THE INVENTION

The invention discloses a gas surface range comprising a compartment having an orifice hood and a connector rigidly secured therein, a modular gas burner cartridge removably positioned in the compartment, the cartridge comprising a pan having a burner and igniter mounted therein, the burner being coupled to the orifice hood, the igniter being coupled to the connector, an air duct adjacent to the surface of the range and extending downwardly, means for providing a down draft through said air duct to ventilate the surface area of the range, means for providing a flow of gaseous fuel to the orifice hood in response to an operator actuable control, and means for providing a high voltage potential to the connector for activating the igniter. Preferably, the pan may comprise an outwardly extending upper lip for supporting the pan in the compartment with a fixed alignment. Also, the burner may comprise a horizontally mounted tubular burner. Furthermore, the providing means may comprise a blower mounted on and communicating with the air duct below the compartment. The term orifice hood herein is defined in its most broad terms to be a structure having an orifice therein through which gaseous fuel may flow to a burner.

The invention may also be practiced by a gas surface range comprising an open top compartment having an orifice hood and connector rigidly secured therein, the connector having first and second terminals, a modular gas burner cartridge removably positioned in the compartment, said cartridge comprising a pan having first and second apertures, at least one gas burner rigidly mounted in the pan having its mixer head communicating outside of said pan through the first aperture, the mixer head being aligned in a fixed spacial relationship with the orifice hood, the cartridge further comprising an igniter rigidly mounted in the pan, the igniter having a rigid conductor extending through the second aperture and making electrical contact with the first terminal, the cartridge further comprising a ground terminal connected to the pan and making electrical contact with the second terminal, an air duct adjacent to the surface of the top and extending downwardly, means for providing a down draft through the air duct to ventilate the surface area of the range, means for providing a flow of gas to the orifice hood in response to an operator actuable control and means for providing a high voltage potential to the first terminal for activating the igniter. Preferably, the range may further comprise a grill supported in an elevated position above the compartment. The grill may comprise a plurality of crossbars perpendicular to the edge of the air duct adjacent to the surface, the crossbars having protrusions extending downwardly therefrom.

The invention also discloses a gas surface range comprising an open top burner box, an air duct substantially dividing the box into two compartments, the duct having an opening communicating with the surface area of the range, the duct extending downwardly therefrom through the floor of the box, means for providing an air down draft into the duct for removing combustion products and cooking vapors from the surface area of the range, at least one orifice hood and connector rigidly secured into corresponding positions of each of the two compartments, a cartridge mounted in each of the two compartments, the cartridge comprising a pan having first and second apertures, a burner rigidly mounted inside the pan and extending through the first aperture wherein the mixer head is aligned in a fixed spacial relationship with the orifice hood of the respective said compartment for receiving gaseous fuel, and an igniter rigidly mounted in the pan and extending outwardly through the second aperture making electrical contact with the connector of the respective said compartment, means for providing a flow of gas to the orifice hood in response to an operator actuable control, and means for providing a high voltage potential to said first terminal for activating the igniter. The range may further comprise a grill supported above one of said compartments in an elevated position forming a gap between the grill and the compartment for exhaust of combustion products.

The invention may also be practiced by the combination of a compartment, first and second orifice hoods rigidly secured in the compartment, an electrical connector rigidly secured in the compartment, a modular gas grill cartridge removably positioned in the compartment, the cartridge having first and second burners having the respective mixer heads aligned with said respective first and second orifice hoods and an igniter coupled to said electrical connector, means for determining the presence of said grill cartridge in the compartment, first and second means for controlling the supply of gaseous fuel respectively to the first and second burners through the first and second orifice hoods, means for ventilating the surface area of the cartridge, and means responsive to the determining means and the controlling means for activating the ventilating means when the grill cartridge is present in the compartment and either of the first or second control means supplies gaseous fuel. It may be preferable that the determining means comprises a microswitch mounted in the compartment. Also, it may be preferable that the grill cartridge further comprise a post extending therefrom for making physical contact with the microswitch when the grill cartridge is positioned in the compartment. Also, the ventilating means may comprise a down draft system. Further, the activating means may comprise a cam coupled to the first and second control means and a microswitch.

BRIEF DESCRIPTION OF THE DRAWINGS

Other objects and advantage of the invention will be more fully understood by a reading of the Description of the Preferred Embodiment with reference to the drawing wherein like characters of reference designate like parts throughout the several drawings and wherein.

DESCRIPTION OF THE PREFERRED EMBODIMENT

Figure 1:
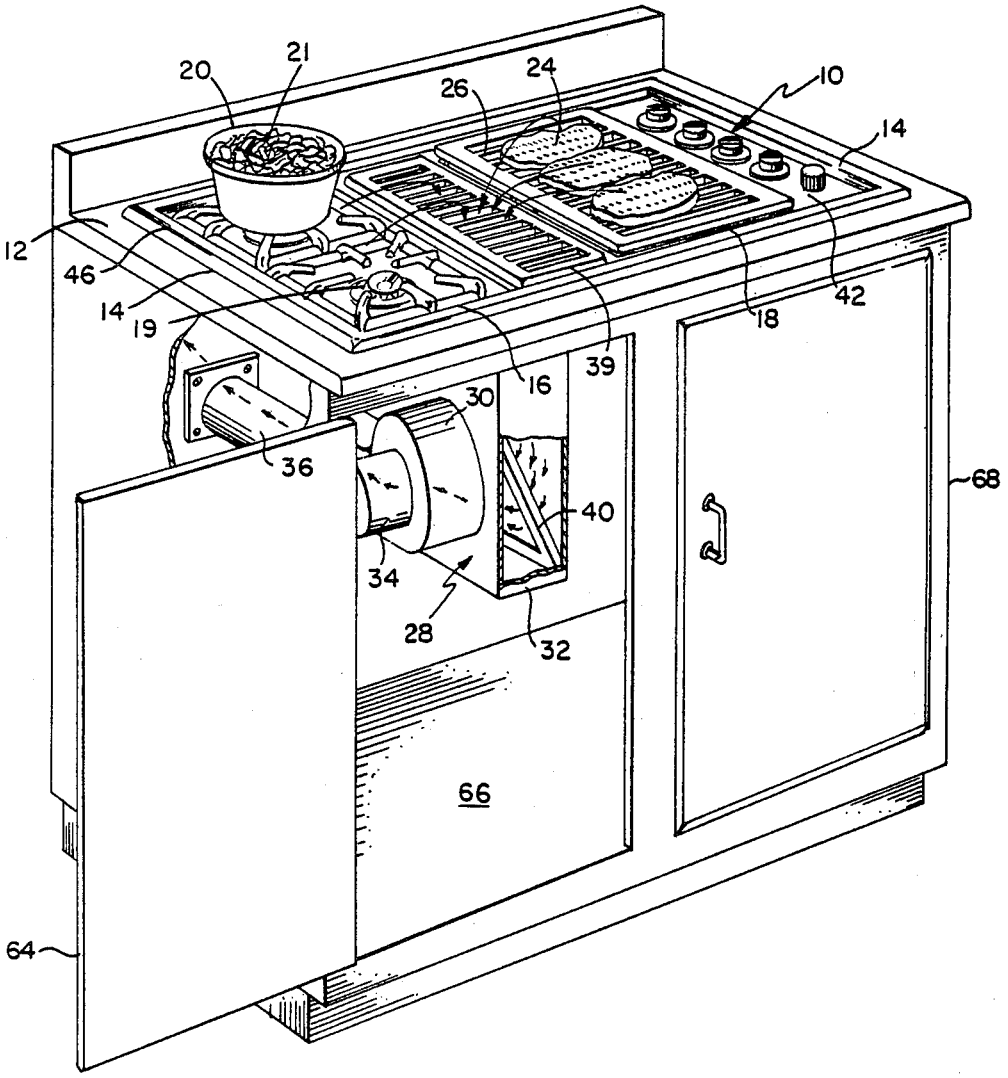
FIG. 1 is an isometric drawing of a built-in counter top gas range embodying the invention.

Referring to FIG. 1, there is shown a gas surface range 10 embodying the invention. As depicted, the range is adapted as a countertop built-in unit; however, the invention may also be used to advantage in other applications such as, for example, a free standing unit. As a countertop built-in unit, range 10 is installed by lowering it through a large rectangular opening in counter 12 until outwardly extending perimeter lip 14 of the range contacts the region of the countertop adjacent to the opening thereby providing support for the range.

As shown on the left side of range 10 in FIG. 1, there there are two conventional gas surface burners 19 which typically are used to heat foods 21 positioned on or in a cooking utensil such as, for example, a pan 20, dish, or griddle. Surface burners 19 are part of modular surface burner cartridge 16 which will be described in detail later herein. Range 10, as shown, also includes modular grill cartridge 18 which is preferably used for cooking foods such as steaks 24 placed on grill 26. Virtually any meat can be cooked on the grill to a char-flavor taste. The grill is fabricated of aluminum and is coated with Teflon to provide a nonstick surface that is easy to clean. Fats and juices emanating from heated foods drip on hot surfaces below where they vaporize and rise past the food to give the char-flavor taste that is preferred by many.

As will be described in detail later herein, cartridges 16 and 18 are removable. Accordingly, the surface configuration of range 10 may easily be altered. For example, grill cartridge 18 can be removed and stored while a surface burner cartridge 16 is replaced into its position. In such configuration, range 10 would have four conventional top surface burners 19 and would not have a grill 26.

Although removal of cooking by-products is typically provided by a hood, range 10 includes a down draft removal system 28. Squirrel cage blower 30 is connected to and communicates with plenum housing 32. Motor 34 provides the drive for blower 30 forcing air outwardly through exhaust duct 36 which is preferably routed to the outdoors; a filtered recirculation system could also be used which would exhaust back into the kitchen. The negative pressure created in housing 32 by blower 30 provides a down draft through square aperture 38 which communicates with the surface environment of range 10 through grating structure 39. More specifically, air, which is represented by arrows in FIG. 1, is drawn across the surface of range 10 and down into housing 32 where it is exhausted by blower 30 through duct 36. Metal filter 40 is positioned in housing 32 to filter large particulate substances from passing on the described exhaust path. Control panel 42, which will be described in detail later herein, controls the operation of the gas burners and blower 30.

Figure 2A:
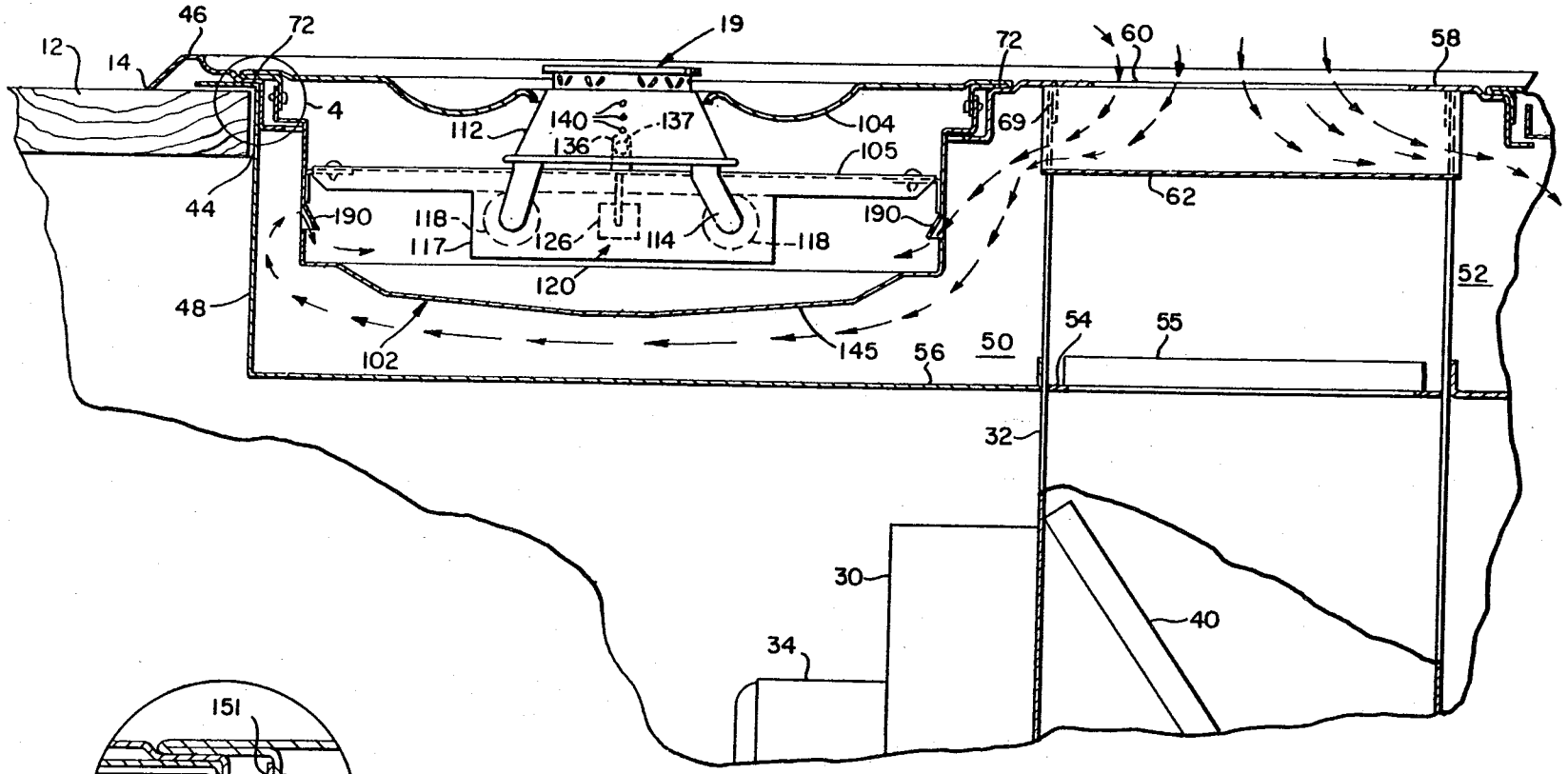
FIGS. 2A and 2B are front sectioned elevation views of the range of FIG. 1 taken respectively along line 2A—2A and 2B—2B of FIG. 3.
Figure 2B:
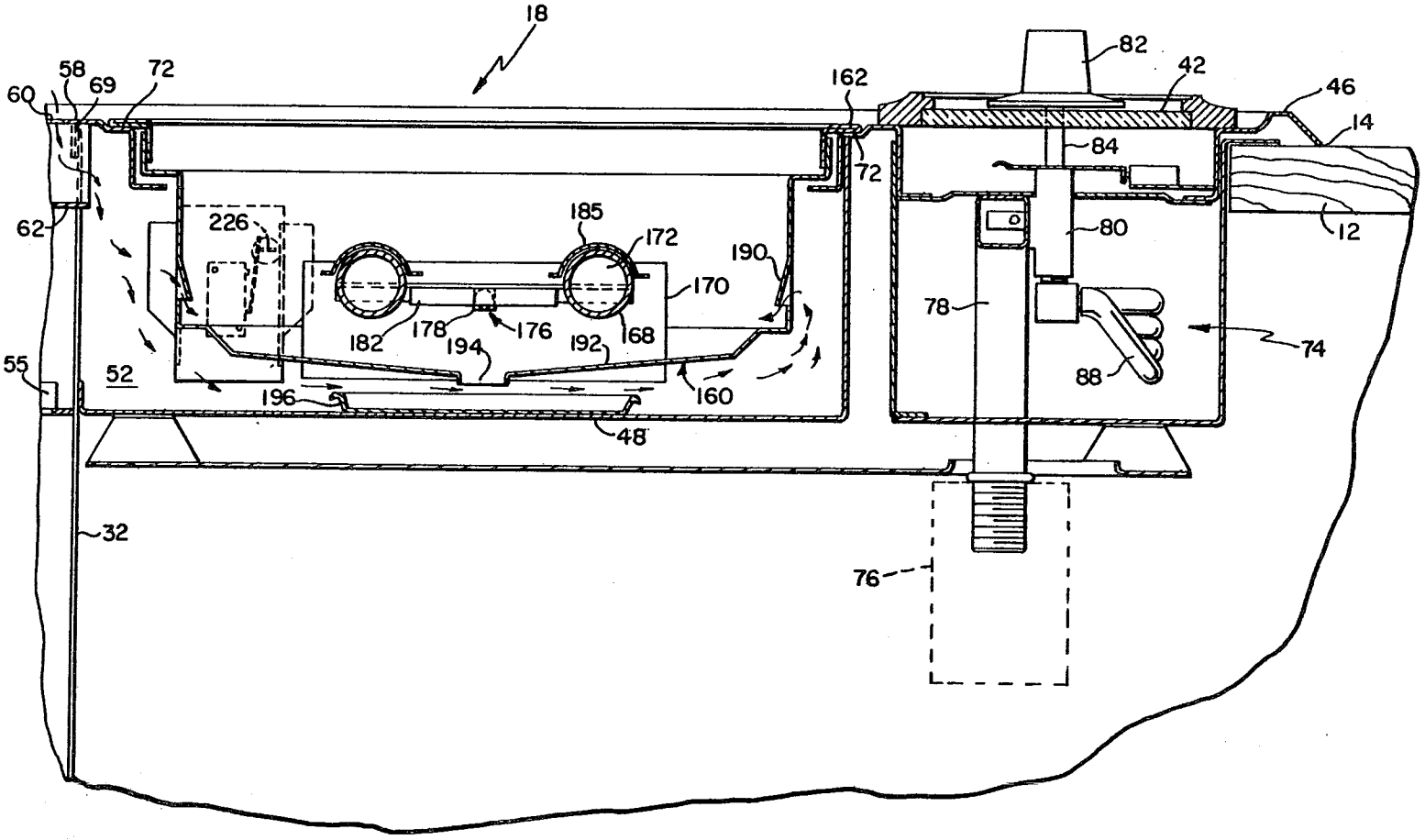
Figures 3, 13:
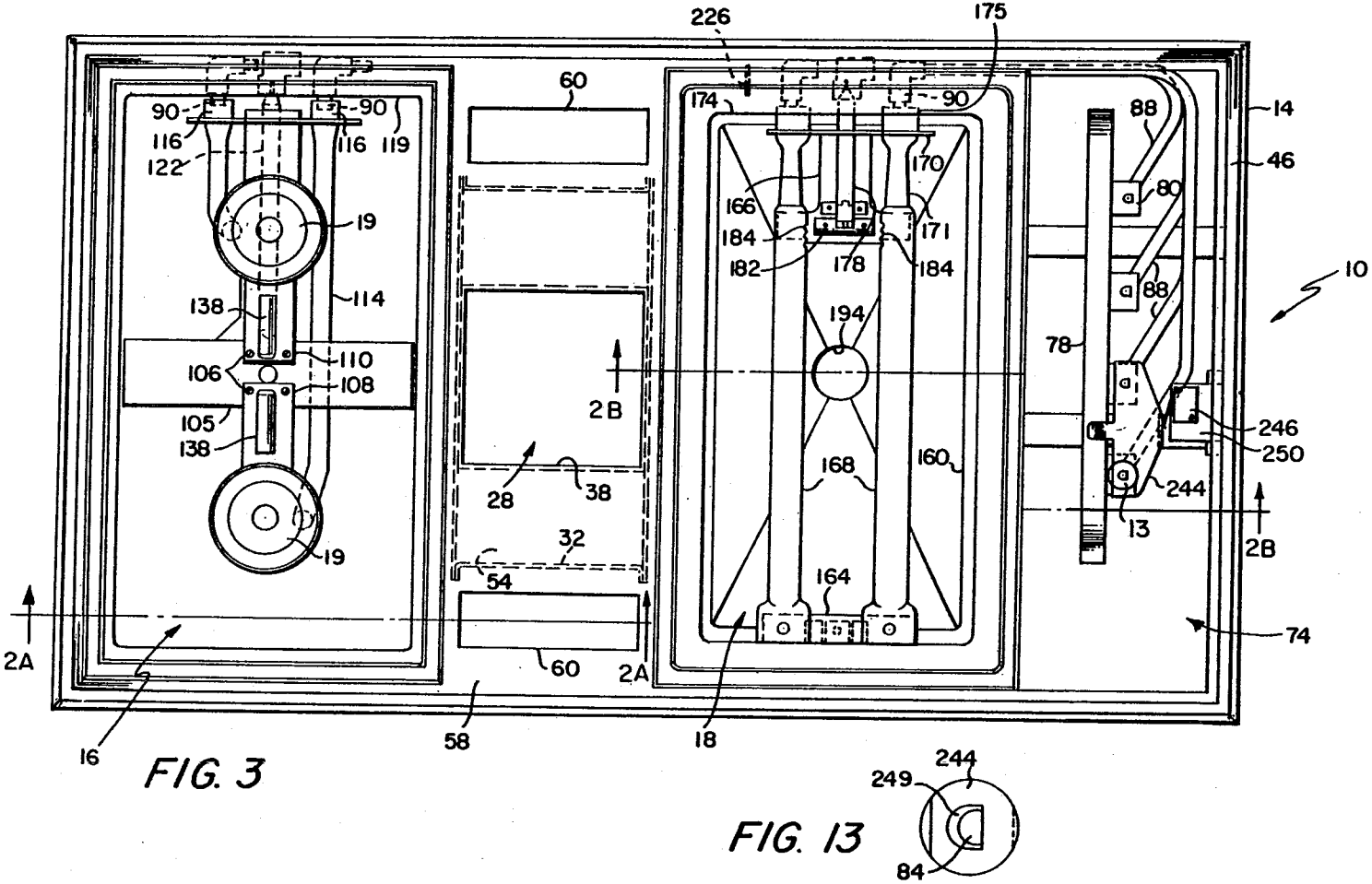
FIG. 3 is a top view of the range of FIG. 1 not showing the cover over the left cartridge, the grating structure over the down draft section, the grill over the right cartridge or the control panel over the control section of FIG. 1.
FIG. 13 is an expanded view of circle 13 of FIG. 3.

Referring to FIGS. 2A and 2B, a sectioned front elevation view of range 10 is divided into the two Figures; the respective Figures are taken along lines 2A—2A and 2B—2B of FIG. 3. As described with reference to FIG. 1, range 10 is supported by lip 14 that contacts counter 12 around a region of the counter adjacent to an opening 44 therein. Lip 14 may preferably be shaped upwardly to form ridge 46 which prevents spills on the range surface from running off of the unit. Lip 14 is connected to a sheet metal structure that forms a burner box 48 for the range. More specifically burner box 48 may substantially define an open top rectangular box which may preferably have a depth of greater than 4 inches and side dimensions of approximately 19 inches by 29 inches. Plenum housing 32 is mounted through an aperture 54 in the central region of burner box 48 and substantially divides the length of box 48 into two substantially identical compartments 50 and 52. As is shown more clearly in FIG. 3, plenum housing 32 does not occupy the entire distance from the front to the back of the burner box. For example, the lengthwise cross-sectional dimensions of housing 32 may be approximately 11 inches which, for the example dimension given above, leaves approximately 4 inches of burner box in front of and behind the centered housing 32. Plenum housing 32 may be secured to the floor 56 of burner box 48 by bending the perimeter 55 of aperture 54 upwards and connecting it to housing 32.

Cover 58, a top view of which is shown in FIG. 3, is positioned over the central portion of burner box 48 where plenum housing 32 is positioned. Cover 58 has apertures 60 which communicate with ducts 62 in front of and behind plenum housing 32. As shown by arrows in FIGS. 2A and 2B, air flows through apertures 60 into rectangular ducts 62 to provide primary and secondary combustion air into compartments 50 and 52. Furthermore, the air path so described provides a safety feature for range 10. More specifically, as shown in FIG. 1, a rapid opening of door 64 may cause a negative pressure in the interior 66 of cabinet 68. Because burner box 48 is not air tight, there may be a rapid flow of air from burner box 48 into the negative pressure interior 66 of abinet 69. Particularly, with cartridge 16, this outward ush of air from the burner box may potentially be strong enough to create a down draft around surface burners 19 with enough force to extinguish the flames. The air path through apertures 60 and ducts 62 into compartments 50 and 52 provides a secondary path for inrushing air thus reducing the flow past burners 19. Cover 58 may connect to the top of plenum housing 32 and a gasket 69 made out of such material as high temperature silicone may preferably be positioned therebetween to eliminate air flow from compartments 50 and 52 through the gap into the down draft of plenum housing 32. It is important that the primary and secondary combustion air for the burners not be subject to turbulence.

Around the outside perimeter of burner box 48 below lip 14 may be positioned a conventional spacer 70, as shown best in FIG. 5, to reduce the required dimension tolerance of opening 44. Around the top of compartments 50 and 52 is a recessed band 72, or ledge which is used to support removable cartridges 16 and 18, restraining them from motion in the horizontal plane. Band 72 is formed by cover 58 on the compartment sides adjacent to plenum housing 32.

Figure 7:
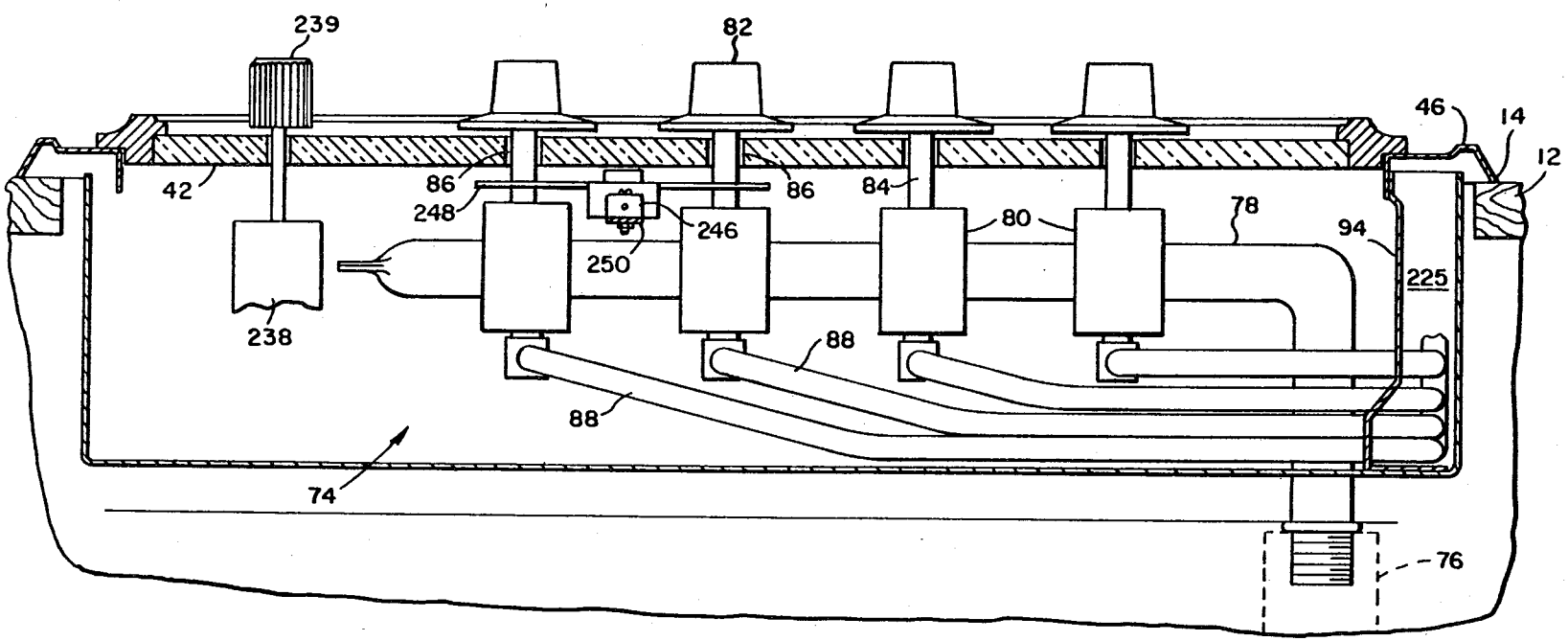
FIG. 7 is a sectioned end view of the control section of FIG. 1.

Still referring to FIG. 2B and also to FIGS. 3 and 7, front, top and end views of control section 74 are respectively shown. In accordance with well-known practice, incoming gas is routed through pressure regulator 76. The regulator is coupled to a tube manifold 78 which, as shown in FIG. 2B is square. Four surface valves 80 are spaced along the tube manifold and are controlled by selector knobs 82 coupled thereto by shafts 84 extending through holes 86 in control panel 42. Referring specifically to FIG. 3, an individual gas pipe 88 connects each valve 80 with one of the four orifice hoods 90 extending through partition 94 mounted inside the burner box. More specifically, the front valve is connected to the right orifice hood in compartment 52; the second valve from the front is connected to the left orifice hood in compartment 52; the next to back valve is connected to the right orifice hood of compartment 50; and the back valve is connected to the left orifice hood of compartment 50. Two orifice hoods 90 extends through holes in partition 94 of each of the compartments 50 and 52 and are secured in rigid alignment therewith by tightening a nut 96 around the throat of each orifice fitting.

Figure 5:
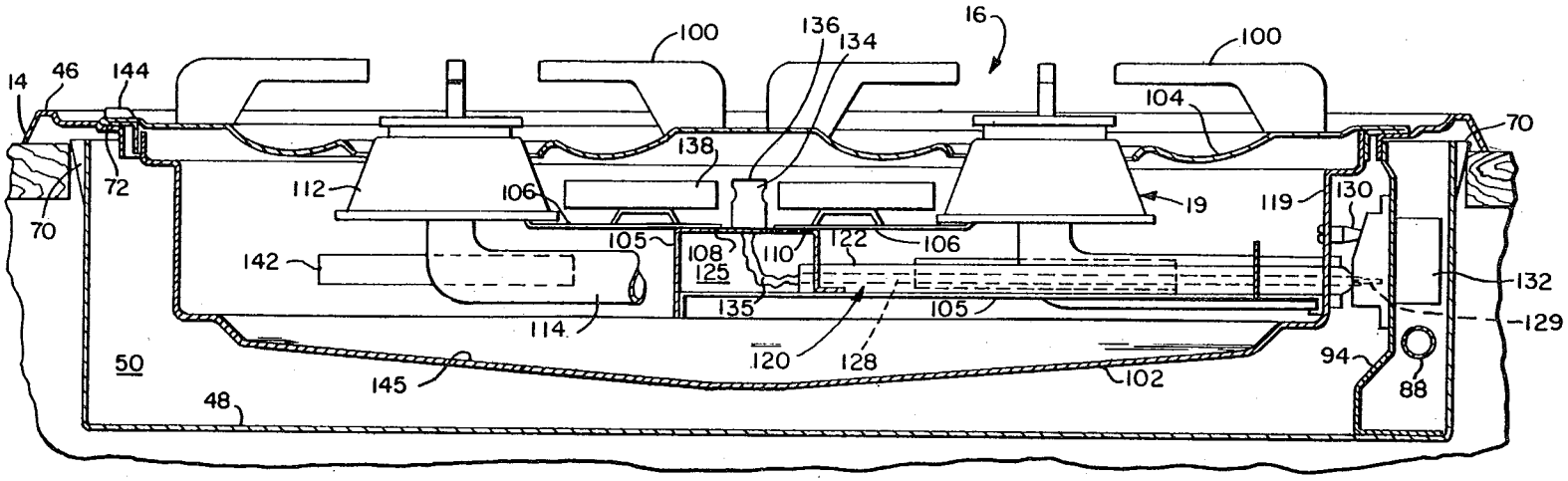
FIG. 5 is a sectioned end view of the cartridge shown in FIG. 2A.

Still referring to FIG. 2A and also to FIGS. 3 and 5, front, top, and end views of modular surface burner cartridge 16 are respectively shown. In FIG. 5, there are shown conventional utensil supporting structures or grates 100 which are not included in the other two views. In FIG. 3, burner cover 104 is not shown even though it is required to support cartridge 16 on band 72 in compartment 50. Metal pan 102 which may preferably have a porcelain enamel coating provides an outer structure for removable modular cartridge 16. Frame 105 is rigidly connected to the inside of pan 102 and is used to mount conventional top surface burners 19 in fixed alignment with pan 102. More specifically, support brackets 106 of the front and back burners 19 are rigidly attached to frame 104 at locations 108 and 110, respectively. Burners 19 are of a conventional blue flame type which includes a hollow ported burner head 112 having a gas receiving chamber for receiving gaseous fuel from a venturi tube 114 or the like. Venturi tubes 114, which preferably include adjustable mixer heads 116, are positioned through circular holes 118 in the back wall 119 of pan 102 and are held in fixed alignment therewith by brace 117 which is connected to frame 105. When cartridge 16 is positioned in compartment 50 as shown in FIGS. 2A, 3, and 5, the mixer heads of venturi tubes align with the orifice hoods 90 according of well-known practice. More specifically, in operation, gas from, each orifice is directed into a venturi tube where the primary combustion air is entrained. Burners 19 may preferably have a rating of approximately 8,000 BTU's per hour.

Igniter 120 preferably has an insulator 122 such as, for example, a thermally insulating ceramic sleeve, which is connected to frame 105 and which spans from a cavity 125 in frame 105 horizontally backwardly through a hole 126 in the back wall 127 of pan 102. Insulator 122 encases a stainless steel conductor 128 having a rigid terminal 129 extending backwardly therefrom; insulator 122 tapers down towards terminal 129. Furthermore, a rigid ground terminal 130 which is connected above hole 126 extends outwardly from the back wall 119 of pan 102 and makes electrical contact with pan 102 and frame 105. As will be described in detail later herein,, when cartridge 16 is positioned in range 10 as shown in the figures, terminal 129 and ground terminal 130 engage connector 132 and make electrical contact with terminals therein. The operation of electric igniters for gas burner is well known in the art and is described in detail in U.S. Pat. No. 3,976,172 dated Dec. 16, 1975, which is assigned to the same assignee as herein, and which is hereby incorporated by reference. In general, however, conductor 128 may be routed to a position in spaced alignment with a dimple target 134 on a grounding plate 136 by a wire 135 which may preferably be braided. When the conductor 128 is energized by a high voltage such as, for example 20,000 to 40,000 volts, an electrical arc jumps from the conductor to the target which is grounded to frame 105 and ground terminal 130. Gas from burner 19 ignition ports 137 which has filled flash tube 138 is ignited and burns back to the ignition ports. Jump ports 140 then carry the flame upwards to light burner 19.

As described earlier herein, primary and secondary combustion air may flow into compartment 50 through apertures 60 and ducts 62. The air enters pan 102 through louvers 142 in the sides thereof. The secondary air passes up along the sides of the heads 112 of burners 19 and through an opening in burner cover 104 to mix with the gas and primary combustion air mixture.

Figure 4:
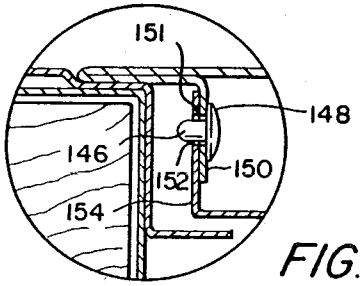
FIG. 4 is an expanded sectional view of circle 4 of FIG. 2A.

The front of burner cover 104 is raised upwards in the center for a few inches to form a handle 144. To remove cartridge 16 from compartment 50, grates 100 are taken off and then the handle 144 is used to raise the front end of cartridge 16 until the bottom 145 of pan 102 clears band 72. Next, cartridge 16 is pulled forward and up as terminal 129 and ground terminal 130 disengage connector 132. To remove burner cover 104 for cleaning or repairing after cartridge 16 has been taken out of compartment 50, two fingers 146 along either side of pan 104 are depressed and the cover is lifted off. More specifically, referring to FIG. 4, each finger 146 is connected to one end of a strip 148 of flexible metal with the other end connected to the inside of a downward extension 150 from burner cover 104. The finger 146 passes through a hole 151 in the extension 150 and may be pushed from the outside in bending the flexible strip 148. When the burner cover 104 and pan 102 are aligned so that the fingers 146 also pass through holes 152 in the upper sides 154 of pan 102, the cover and pan are rigidly engaged. Accordingly, the pan is connected to the cover and the two are supported by the cover on band 72 when positioned in range 10.

Figure 6:
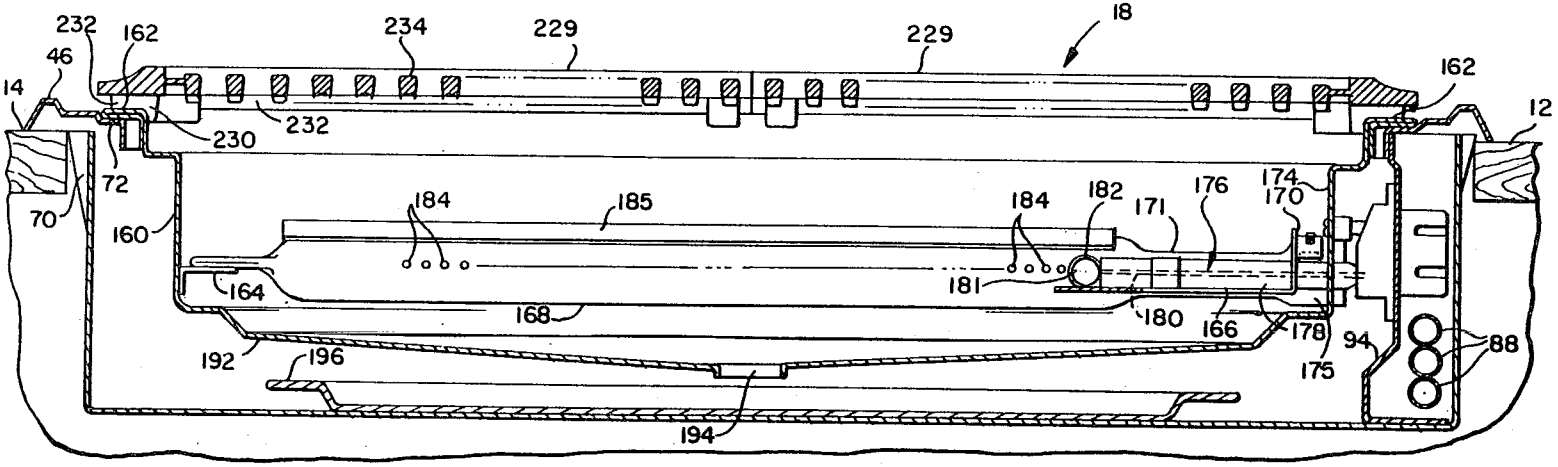
FIG. 6 is a sectioned end view of the cartridge shown in FIG. 2B.

Referring to FIG. 2B and also to FIGS. 3 and 6, front, top, and end views of modular grill cartridge 18 are respectively shown. Grill 26 is shown in FIG. 6 but is not shown in the other two figures. Unlike pan 102, pan 160 does not have a cover which supports it in range 10 on band 72. Accordingly, pan 160 has an outwardly extending rim 162 at the top which seats on band 72 when cartridge 18 is positioned in range 10. Brackets 164 and 166 are connected to the inside of pan 160. Tubular burners 168 are rigidly attached to bracket 164 in front and to brace 170 which is connected to bracket 166 in back. Similar to cartridge 16, the venturi tubes 171 of burners 168 pass through holes 172 in the back wall 174 of pan 160 and adjustable mixer heads 175 are aligned with orifice hoods 90 when cartridge 18 is positioned in range 10. Also similar is an igniter 176 which has a ceramic insulator 178 protruding through hole 179 with a rigid stainless steel conductor 180 extending therefrom to form a terminal 129 for engagement with connector 132. Furthermore, pan 160 has a ground terminal 130 which also engages connector 132 when cartridge 18 is positioned in range 10. When igniter 176 is activated, an electrical arc jumps from the conductor to the target 181 igniting gas which burns back through flash tubes 182 to ignite tubular burners 168. Each tubular burner may preferably have side ports 184 and an output rating of 8,000 BTU's per hour. Tubular burners 168 may preferably have hoods 185 extending horizontally from a position approximately ⅛ inch above the ports 184 so as to hold a flame at lower rates of gas flow; furthermore, the hoods 185 substantially prevent dripping grease from clogging ports 184. Pan 160 has louvers 190 in the sides for entrance of combustion air. As described earlier herein, the combustion air may enter compartment 52 through aperture 60 and ducts 62. The bottom 192 of pan 160 is sloped downward to an opening 194 in the center thereof. Fats and hot juices from grilled meat may run down the sloping bottom of the pan, through opening 194, and drip in grease pan 196. The remove grill cartridge 18 from its depicted position in range 10, grill 26 is removed and then, using bracket 164 as a handle, the front of cartridge 18 is lifted until the bottom 192 of the pan clears band 72. Then, like removal of cartridge 16, cartridge 18 is pulled forward and up as terminal 129 and ground terminal 130 disengage connector 132.

Figure 8:
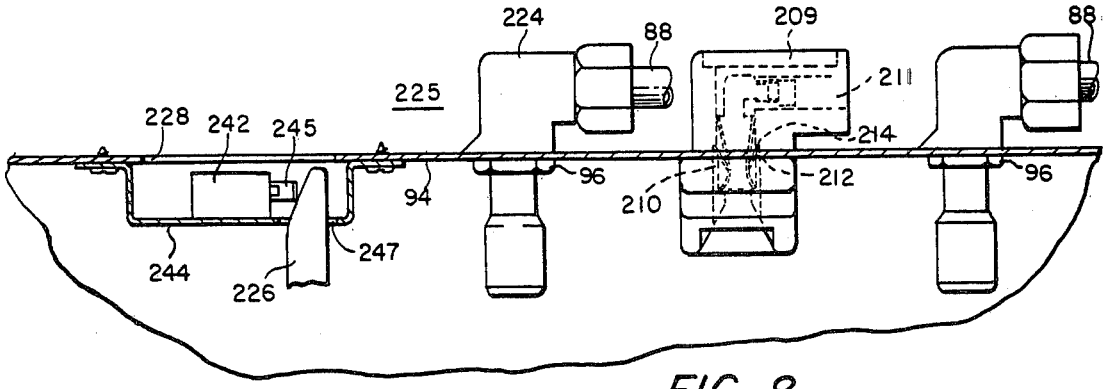
FIG. 8 is a top view of the partition of compartment 52 showing connector 132, orifice hoods 90 and more.
Figure 9:
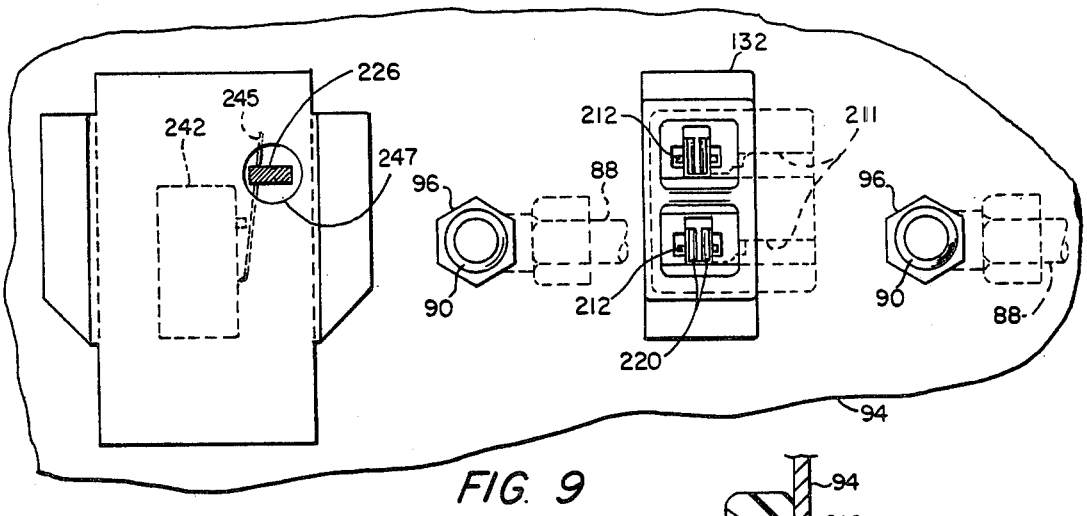
FIG. 9 is a front view of FIG. 8.
Figure 10:
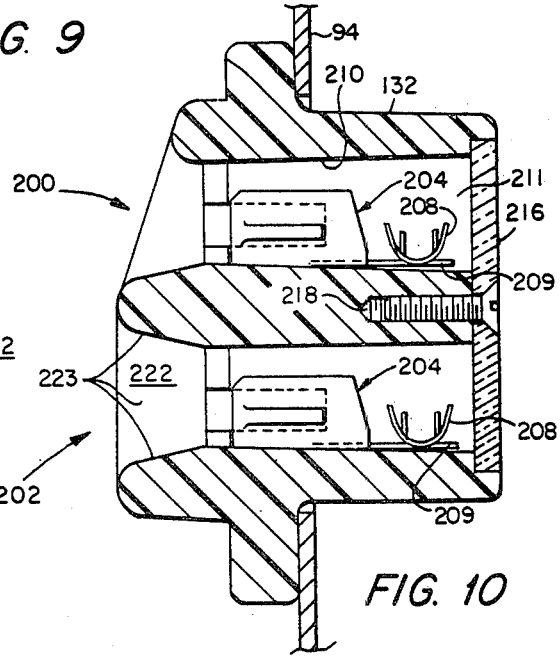
FIG. 10 is a sectioned end view of connector 132.

Referring to FIGS. 8, 9, and 10, there are shown top, front, and end view respectively of connector 132. Connector 132 comprises a material having electrical insulating and heat resistant properties such as, for example, L5 steatite ceramic. The top receptacle 200 is used to provide a removable connection for ground terminal 130. The bottom receptacle 202 provides a removable connection for terminal 129. Terminals 204 make electrical contact with respective terminals 129 and 130 when cartridges 16 or 18 are positioned in range 10. An insulated wire (not shown) which is part of the igniter circuit to be described later herein, is connected to terminal 204 by crimping arms 208 therearound. Terminals 204 are then inserted into channels 210 in connector 132 until clips 212 engage ledges 214 thereby rigidly securing the two. In this configuration, arm base 209 which is substantially perpendicular to channels 210 is positioned in slots 211. Next an insulating back 216 is attached over the crimped arms 208 and its base 209 by screw 218. Accordingly, insulated wires exit connector 132 parallel to partition 94. Connector 132 may be secured through a hole in partition 94 before or after the connection of the insulated wire. As shown best in FIG. 9, when terminals 129 and 130 are inserted in to respective receptacles 202 and 204, the terminals make electrical contact with electrical blades 220. As shown best in FIG. 10, the entrances 222 to receptacle 204 is recessed and has tapered surfaces 223. The taper is designed to substantially coincide with the taper of insulators 122 and 178 from which terminals 129 extend. Accordingly, when terminal 129 is mated with connector 132, the tapered portion of insulator 122 or 178 is spaced relatively closely with surfaces 223 for the distance of the recessed entrance 222 thus reducing the possibility of grease spattering into receptacle 204; enough spacing is provided on the top so that the front of pan 102 or 160 may be slightly elevated to remove the respective modular cartridge 16 or 18. Furthermore, recessed entrance 222 substantially isolates the conductor from pan 102 or 160 or any other metallic object to which electrical current could jump. Receptacle 202 is recessed more on the bottom than on the top as shown. It may be preferable to glaze the portion of connector 132 that is positioned on compartment 50 or 52 side of partition 94. Still referring to FIGS. 8 and 9, there are shown top and front views respectively of conventional orifice fittings 224 for routing the gas pipes 88 through partition 94 to orifices hoods 90; as shown in other figures, gas pipes 88 are routed in passageway 225 formed by burner box 48 and partition 94. It is important to note that orifice hoods 90 and connector 132 are held in fixed alignment with partition 94. Furthermore, partition 94 is in fixed alignment with band 72 which securely positions a cartridge 16 or 18 when inserted into range 10. Accordingly, the mixer heads 116 or 175 are aligned to the orifices and terminals 129 and 130 are aligned to respective receptacles 202 and 204 of connector 132. Accordingly, modular cartridges 16 or 18 can be removed and replaced from compartments 50 and 52 for cleaning or changing the burner configuration of the surface of range 10.

Although modular cartridge 16 can be inserted into either or both compartments 50 and 52 thus providing the option of having four surface burners 19, modular grill cartridge 18 has been modified so that it will only insert into compartment 52. More specifically, a post 226 extends from the back wall of modular grill cartridge 18. An opening 228 in partition 94 of compartment 52 permits post 226 to extend therethrough. However if an attempt were made to insert modular grill cartridge 18 into compartment 50, post 226 would contact partition 94 thus prohibiting the backward movement of the cartridge and the seating of rim 162 on band 72. The purpose of not being able to insert modular grill cartridge 18 into compartment 50 will be described later herein.

Figure 11:
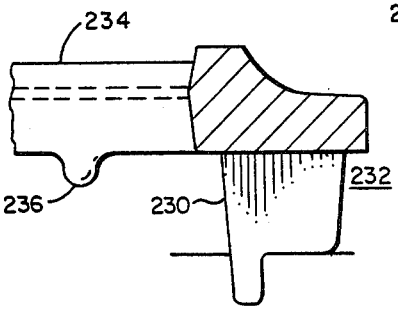
FIG. 11 is a sectioned part of the edge of grill 26 showing support structures 230 and protrusions 236.

Referring to FIGS. 6 and 11, an end view and an expanded front view along the side of grill 26 are shown. Grill 26 comprises two identical sections 229, one mounted on the front and the other mounted on the rear. Each section is elevated by support structures 230 which rest on rim 162 of pan 160. Accordingly, even if a flat surface such as a cookie sheet covers the entire upper surface of grill 26, the combustion products can still escape from the interior of pan 160 through spacing 232. It was found that with the grill elevated and the down draft adjacent to the grill, a relatively strong draft of air across the underside of crossbars 234 caused grease which had accumulated on the underside thereof to migrate toward plenum housing 32 and splatter on cover 58. Downward protrusions 236 were added to crossbars 234 so that grease flowing along the underside of the crossbar would drip off down into pan 160.

Figure 12:
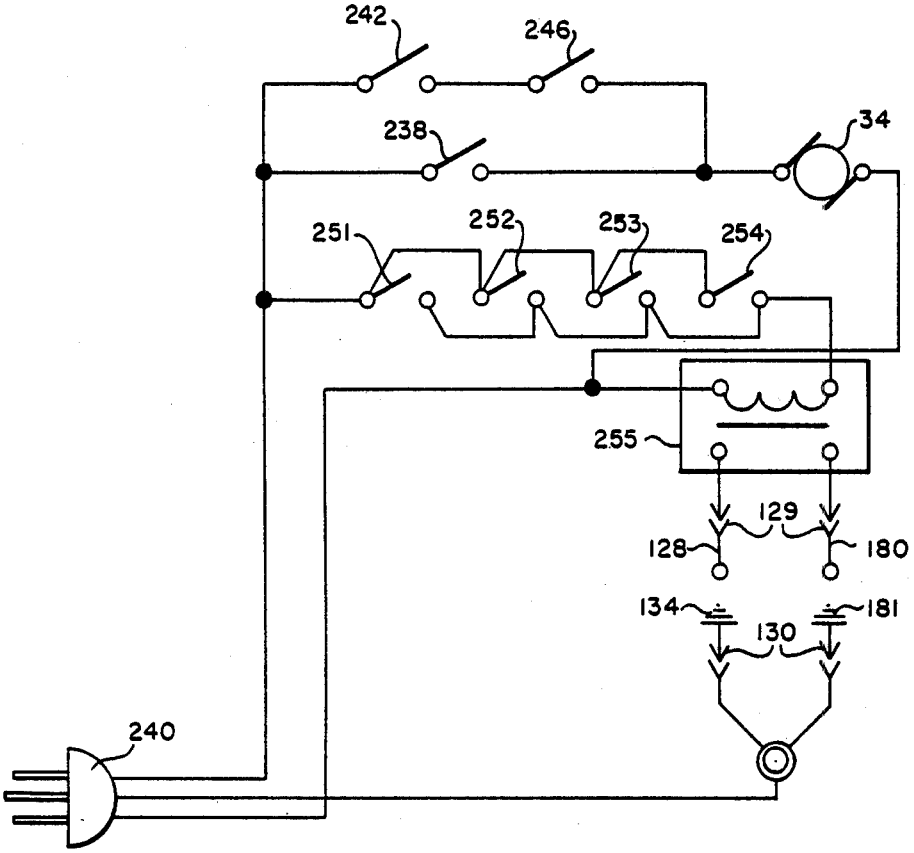
FIG. 12 is an electrical schematic of the range of FIG. 1.

Referring to FIG. 12, an electrical schematic of range 10 is shown. Switch 238 controlled by knob 239 on control panel 42 can be used to activate down draft motor 34 by closing the circuit to AC receptacle plug 240. Further than having the down draft system 28 activated by option of the operator, it was desirable to provide an interlock such that it is activate any time a modular grill cartridge 18 is in use. Microswitch 242 is connected to plate 244 which is attached across opening 228 in partition 94 of compartment 52 as shown in FIGS. 8 and 9. Switch 242 closes in response to movement of its arm 245 caused by post 226 extending from pan 160 of modular grill cartridge 18 through hole 247 in plate 244. Accordingly, microswitch 242 senses the presence of cartridge 18 but not cartridge 16. Microswitch 246 is closed by either of the two front gas valves being in an open position. More specifically, as shown in FIG. 2B, 3 and 7, front, top and end views of bracket 248 or cam are respectively shown. The cam has two partially circular holes 249 through which shafts 84 insert as shown in FIG. 13. Shafts 84 are also not completely circular so that when either of the front two shafts are turned from the gas of position, the cam has movement in the direction of microswitch 246 thus closing it. Microswitch 246 is mounted on platform 250. Accordingly, referring again to FIG. 12, whenever a modular grill cartridge 18 is inserted in compartment 52 and either of its two tubular burners 168 is turned on as controlled by the two front valves of the control section, motor 34 driving down draft system 28 is automatically activated. Accordingly, post 226 provides for the sensing of modular grill cartridge 18 in compartment 52 and also prevents cartridge 18 from being inserted in compartment 50 where it would not be sensed.

In accordance with well-known pilotless ignition, switches 251–254 are connected to the respective valves 80 and the turning of anyone of them to the ignition position causes the conventional spark module 255 to be activated resulting in high voltage being provided to the two igniters. Terminals 129, conductors 128 and 180, targets 134 and 181, and grounding terminals 130 are schmatically shown. More specifically, spark module 255 provides a high voltage to be coupled through connectors 132 of compartments 50 and 52 to terminals 129 of igniters 120 and 176. The current having jumped the spark gaps to targets 134 and 181 is returned through terminals 130 to connectors 132.

As has been described earlier herein, range 10 has two compartments 50 and 52 into which two modular cartridges 16 and 18 can be positioned. In one configuration, one cartridge 16 may preferably comprise two conventional surface burners 19 and the other cartridge 18 two elongated burners 168 to provide for grilling. In another configuration, the grill can be removed and a cartridge having two more surface burners positioned therein. It would be apparent to one skilled in the art to develop other types of modular cartridges to provide other configurations. For examples each cartridge could contain only one burner. In addition to providing various surface configurations, the removability of the modular cartridges also provides ease of cleaning. More specifically, for example, modular grill cartridge 18 including pan 160, burners 168 and igniter 176 can be put into a standard dishwasher without further disassembly into component parts.

From a reading of the preferred embodiment herein, modifications and alterations will be apparent to one skilled in the art without departing from the spirit and scope of the invention. Accordingly, it is intended that the scope of the invention be limited only by the appended claims.

I claim:

1. In combination:

a compartment;

first and second orifice hoods rigidly secured in said compartment;

an electrical connector rigidly secured in said compartment;

a modular gas grill cartridge removably positioned in said compartment, said cartridge having first and second burners having the respective mixer heads aligned with said respective first and second orifice hoods and an igniter coupled to said electrical connector;

means for determining the presence of said grill cartridge in said compartment;

first and second means for controlling the supply of gaseous fuel respectively to said first and second burners through said first and second orifice hoods;

means for ventilating the surface area of said cartridge; and means responsive to said determining means and said controlling means for activating said ventilating means when said grill cartridge is present in said compartment and either of said first or second control means supplies gaseous fuel.

2. The combination in accordance with claim 1 wherein said determining means comprises a microswitch mounted in said compartment.

3. The combination in accordance with claim 2 wherein said grill cartridge further comprises a post extending therefrom for making physical contact with said microswitch when said grill cartridge is positioned in said compartment.

4. The combination in accordance with claim 1 wherein said ventilating means comprises a down draft system.

5. The combination in accordance with claim 1 wherein said activating means comprises a cam coupled to said first and second control means and a second microswitch.

* * * * *